US009504885B2

(12) United States Patent
Ban

(10) Patent No.: US 9,504,885 B2
(45) Date of Patent: Nov. 29, 2016

(54) GOLF CLUB HEAD

(71) Applicant: BRIDGESTONE SPORTS CO., LTD., Tokyo (JP)

(72) Inventor: Wataru Ban, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 14/693,051

(22) Filed: Apr. 22, 2015

(65) Prior Publication Data

US 2015/0360091 A1 Dec. 17, 2015

(30) Foreign Application Priority Data

Jun. 12, 2014 (JP) ..... 2014-121827

(51) Int. Cl.
*A63B 53/04* (2015.01)

(52) U.S. Cl.
CPC .... *A63B 53/0466* (2013.01); *A63B 2053/0408* (2013.01); *A63B 2053/0445* (2013.01)

(58) Field of Classification Search
CPC ..... A63B 53/0466; A63B 2053/0445; A63B 2053/0408
USPC ..... 473/324–350, 287–292
See application file for complete search history.

(56) References Cited

U.S. PATENT DOCUMENTS

| | | | | | |
|---|---|---|---|---|---|
| 3,869,126 | A * | 3/1975 | Thompson | A63B 53/04 | 473/331 |
| 4,754,971 | A * | 7/1988 | Kobayashi | A63B 53/04 | 473/290 |
| 4,754,975 | A * | 7/1988 | Aizawa | A63B 53/04 | 473/348 |
| 4,768,787 | A * | 9/1988 | Shira | A63B 53/04 | 473/331 |
| 4,812,187 | A * | 3/1989 | Honma | A63B 53/04 | 156/245 |
| 5,029,864 | A * | 7/1991 | Keener | A63B 53/04 | 473/331 |
| 5,082,278 | A * | 1/1992 | Hsien | A63B 53/04 | 473/242 |
| 5,110,131 | A * | 5/1992 | Long | A63B 53/00 | 473/349 |

(Continued)

FOREIGN PATENT DOCUMENTS

| | | |
|---|---|---|
| JP | 60-25654 U | 2/1985 |
| JP | 62-144674 A | 6/1987 |

(Continued)

*Primary Examiner* — Sebastiano Passaniti
(74) *Attorney, Agent, or Firm* — Sughrue Mion, PLLC

(57) ABSTRACT

A golf club head of this invention is a wood type golf club head including a face portion, a crown portion, and a sole portion. A plurality of grooves arrayed in the vertical direction of the face portion are formed in the face portion. The depth of the plurality of grooves is less than 0.025 mm. When pitches between, out of the plurality of grooves, grooves adjacent in the vertical direction of the face portion are represented by $P_1, P_2, \ldots, P_n$ sequentially from the upper side to the lower side of the face portion, $P_1 \geq P_2 \geq \ldots \geq P_n$, and $P_1 > P_n$.

10 Claims, 6 Drawing Sheets

(56) References Cited

U.S. PATENT DOCUMENTS 5,190,289 A * 3/1993 Nagai ..... A63B 53/00 473/327
5,230,510 A * 7/1993 Duclos ..... A63B 53/04 473/328
5,358,249 A * 10/1994 Mendralla ..... A63B 53/04 473/331
5,397,127 A * 3/1995 Kawada ..... A63B 53/04 473/324
5,591,092 A * 1/1997 Gilbert ..... A63B 53/04 473/330
5,688,186 A * 11/1997 Michaels ..... A63B 53/04 473/290
5,709,617 A 1/1998 Nishimura et al.
6,129,953 A * 10/2000 Mertens ..... A63B 53/04 427/201
6,398,665 B1 * 6/2002 Antonious ..... A63B 53/04 473/330
6,558,272 B2 * 5/2003 Helmstetter ..... A63B 53/04 473/329
6,669,579 B2 * 12/2003 Kosmatka ..... A63B 53/04 473/329
7,452,283 B2 * 11/2008 Hettinger ..... A63B 53/0487 473/249
7,594,862 B2 * 9/2009 Gilbert ..... A63B 53/04 473/330
7,695,377 B2 * 4/2010 Yamagishi ..... A63B 53/047 473/331
7,976,406 B2 * 7/2011 Gilbert ..... A63B 53/047 473/330
2003/0134687 A1 * 7/2003 Truesdale ..... A63B 53/047 473/330
2004/0038745 A1 2/2004 Ahlqvist
2005/0049073 A1 * 3/2005 Herber ..... A63B 53/0466 473/328
2006/0025233 A1 * 2/2006 Lin ..... A63B 53/047 473/330
2006/0154739 A1 * 7/2006 Mann, Jr. ..... A63B 53/04 473/330
2013/0217513 A1 * 8/2013 Amano ..... A63B 53/047 473/331
2014/0274452 A1 * 9/2014 Oldknow ..... A63B 53/047 473/331

FOREIGN PATENT DOCUMENTS

JP 9-47530 A 2/1997
JP 2004-201787 A 7/2004

* cited by examiner

| | SHALLOW GROOVES | | | | SCORE LINES | | | | SPIN AMOUNT (rpm) |
|---|---|---|---|---|---|---|---|---|---|
| | WIDTH (mm) | DEPTH (mm) | PITCH (mm) | | WIDTH (mm) | DEPTH (mm) | PITCH (mm) | | |
| #1 | 0.2 | 0.012 | UPPER AREA | 3.0 | NOT FORMED | | | | 2950 |
| | | | CENTRAL AREA | 1.2 | | | | | 3100 |
| | | | LOWER AREA | 0.6 | | | | | 3320 |
| #2 | NOT FORMED | | | | 0.8 | 0.25 | UPPER AREA | 6.0 | 2900 |
| | | | | | | | CENTRAL AREA | 4.0 | 3230 |
| | | | | | | | LOWER AREA | 2.0 | 3600 |
| #3 | NOT FORMED | | | | 0.8 | 0.25 | UPPER AREA | 4.0 | 2790 |
| | | | | | | | CENTRAL AREA | | 3600 |
| | | | | | | | LOWER AREA | | 3770 |

GOLF CLUB HEAD

BACKGROUND OF THE INVENTION

1. Field of the Invention

The present invention relates to a wood type golf club head.

2. Description of the Related Art

Generally in a golf club head, the back spin amount of a shot tends to change depending on the position of the impact point on the face portion. For example, in a wood type golf club head, if the position of the impact point is higher than the sweet spot, the back spin amount tends to decrease. If the impact point is at a position lower than the sweet spot, the back spin amount tends to increase.

To reduce the difference in the back spin amount generated by the vertical variation in the impact point position, a face portion having areas of difference surface roughnesses has been proposed. Golf club heads described in Japanese Utility Model Laid-Open No. 60-25654, Japanese Patent Laid-Open No. 62-144674, Japanese Patent Laid-Open No. 9-047530, and U.S. Patent Application Publication No. 2004/0038745 are based on an idea that the back spin amount can be increased by increasing the surface roughness of the face.

On the other hand, in a golf club head having a relatively small loft angle (for example, 20° or less), in some cases, the higher the surface roughness is, the lower the back spin amount is. A golf club head described in Japanese Patent Laid-Open No. 2004-201787 is based on an idea that the roughness of the face is decreased at a position where the back spin amount decreases, and the roughness of the face is increased at a position where the back spin amount increases. That is, the golf club head is based on an idea opposite to that of Japanese Utility Model Laid-Open No. 60-25654, Japanese Patent Laid-Open No. 62-144674, Japanese Patent Laid-Open No. 9-047530, and U.S. Patent Application Publication No. 2004/0038745.

In the wood type golf club head, since the loft angle is relatively small, it is effective to decrease the roughness of the face at a portion to increase the back spin amount and increase the roughness of the face at a portion to decrease the back spin amount, as described in Japanese Patent Laid-Open No. 2004-201787.

As a method of adjusting the surface roughness of the face portion, a process such as sand blast or shot peening is known. However, to implement a change in the surface roughness of the face portion as designed, the process may be difficult or may need effort. As another method of adjusting the surface roughness of the face portion, contriving score lines is considerable. However, in, for example, a golf club head for games, it is difficult to implement a change in the surface roughness of the face portion as designed in terms of conformity to rules (R & A rules).

SUMMARY OF THE INVENTION

It is an object of the present invention to decrease the difference in the back spin amount caused by a vertical variation in the impact point position on a wood type golf club head.

According to an aspect of the present invention, there is provided a wood type golf club head including a face portion, a crown portion, and a sole portion, wherein a plurality of grooves arrayed in a vertical direction of the face portion are formed in the face portion, a depth of the plurality of grooves is less than 0.025 mm, and when pitches between, out of the plurality of grooves, grooves adjacent in the vertical direction of the face portion are represented by $P_1, P_2, \ldots, P_n$ sequentially from an upper side to a lower side of the face portion $P_1 \geq P_2 \geq \ldots \geq P_n$, and $P_1 > P_n$.

Further features of the present invention will become apparent from the following description of exemplary embodiments (with reference to the attached drawings).

DESCRIPTION OF THE EMBODIMENTS

First Embodiment

Figure 1A:
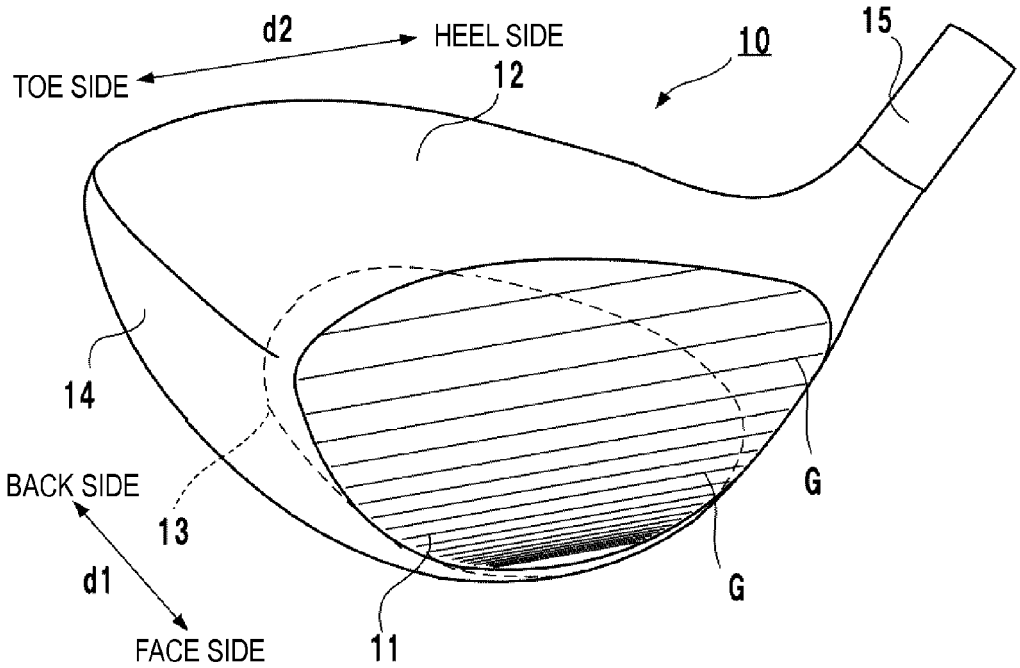
FIG. 1A is a perspective view of a golf club head according to an embodiment of the present invention.
Figure 1B:
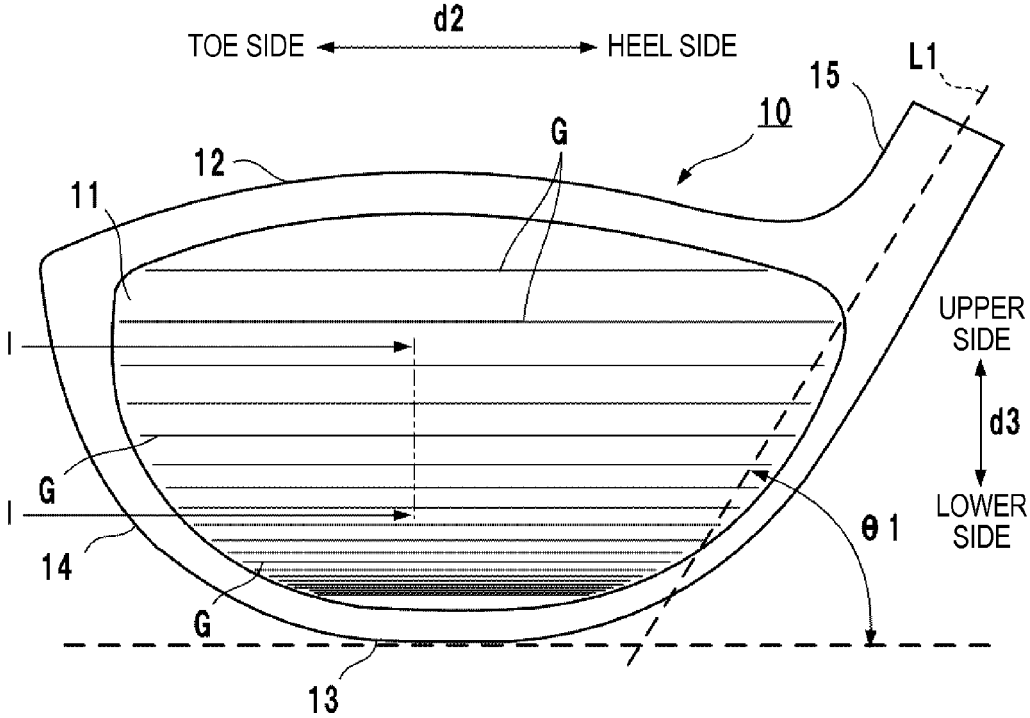
FIG. 1B is a front view of the golf club head shown in FIG. 1A viewed from the face side.

FIG. 1A is a perspective view of a golf club head 10 according to an embodiment of the present invention. FIG. 1B is a front view of the golf club head 10 viewed from the side of a face portion 11.

The golf club head 10 is hollow and has peripheral walls formed from the face portion 11, a crown portion 12, a sole portion 13, and a side portion 14. The surface of the face portion 11 forms a face (striking face). A bulge and a roll are formed on the face. The crown portion 12 forms the upper portion of the golf club head 10. The sole portion 13 forms the bottom portion of the golf club head 10. The side portion 14 forms the portion between the sole portion 13 and the crown portion 12. The golf club head 10 includes a hosel portion 15 to which a shaft is attached.

An arrow d1 in FIG. 1A indicates the face-back direction, and an arrow d2 indicates the toe-heel direction. An arrow d3 in FIG. 1B indicates the vertical direction of the face portion 11. The face-back direction normally corresponds to a target line direction (target direction of a shot). The toe-heel direction is the direction in which the toe-side end and the heel-side end of the sole portion 13 are connected. The vertical direction of the face portion 11 is defined based on the golf club head grounded in accordance with a predetermined lie angle. In this embodiment, the vertical direction is the direction of sole portion 13—crown portion 12. Note that the lie angle is an angle θ1 made by a shaft axis L1 and the ground surface, as shown in FIG. 1B.

The golf club head 10 is a golf club head for a driver. However, the present invention is applicable to wood type golf club heads including a fairway wood other than drivers. The present invention is particularly suitable for a golf club head having a loft angle of 20° or less.

The golf club head 10 can be made of a metal material. Examples of the metal material are a titanium-based metal (for example, titanium alloy 6Al-4V-Ti), stainless steel, and a copper alloy such as beryllium copper.

The golf club head 10 can be assembled by joining a plurality of parts. For example, the golf club head 10 can be formed from a main body member and a face member. The main body member forms the peripheral portions including the crown portion 12, the sole portion 13, the side portion 14, and the face portion 11. An opening is formed at part of the portion corresponding to the face portion 11. The face member is joined to the opening of the main body member.

Figure 2A:
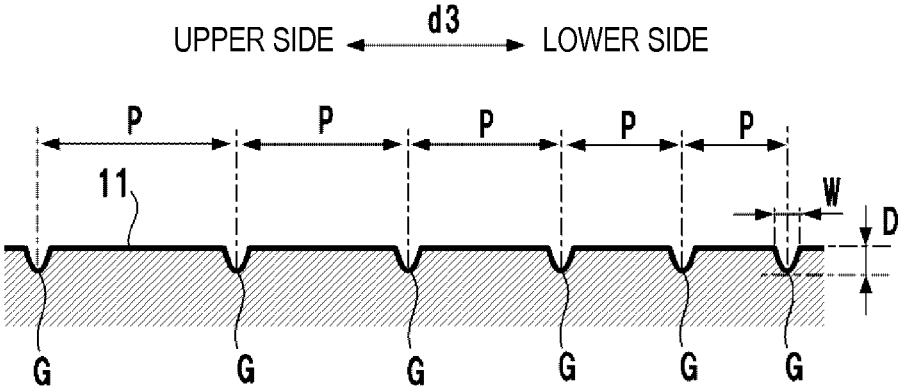
FIG. 2A is a sectional view taken along a line I-I in FIG. 1B.

A plurality of shallow grooves G are formed in the surface of the face portion 11. The plurality of shallow grooves G will be described with reference to FIG. 2A in addition to FIGS. 1A and 1B. FIG. 2A is a sectional view taken along a line I-I in FIG. 1B. The line I-I is a line in the direction d3.

The plurality of shallow grooves G are arrayed in the vertical direction (direction d3) of the face portion 11. In this embodiment, the shallow grooves G are straight grooves extending in the toe-heel direction and are parallel to each other. The shallow grooves G are formed so as to be level when the golf club head 10 is grounded toward the target direction. In this embodiment, each shallow groove G is formed straight without any break. However, it may break halfway.

A depth D of each shallow groove G is less than 0.025 mm. For this reason, the shallow grooves G are handled not as so-called score lines but as elements (for example, elements by milling) that roughen the face under the rules (R & A rules) of golf club heads. The shallow grooves G are formed to adjust the surface roughness of the face. Hence, the depth D is preferably 0.005 mm or more. A width W of each shallow groove G preferably ranges from 0.1 mm (inclusive) to 0.3 mm (inclusive). The width W is the width of each shallow groove G in the vertical direction (the planar direction of the face in the direction d3).

In the example of FIG. 2A, the section of each shallow groove G has an elliptic arc outline. However, the outline shape of the section of each shallow groove G is not limited to this, and various outline shapes such as an arc shape, triangular shape, rectangular shape, and trapezoidal shape can be employed.

Figure 2B:
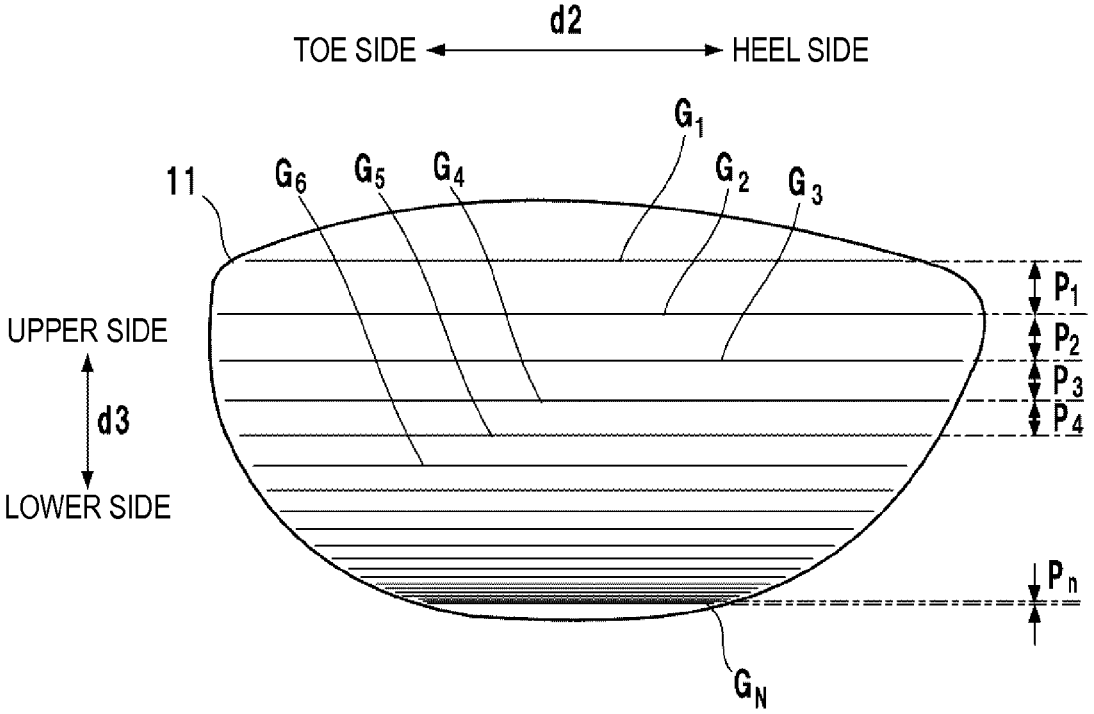
FIG. 2B is an explanatory view of a change in the pitch.

As shown in FIG. 2A, a pitch P is set between the shallow grooves G adjacent in the vertical direction. The pitch P changes such that the surface roughness of the face portion 11 increases from the upper portion to the lower portion. FIG. 2B is an explanatory view.

Referring to FIG. 2B, N shallow grooves G are formed. To discriminate the shallow grooves G, they are sequentially numbered as $G_1$, $G_2$, $G_3$, $G_4$, . . . , $G_N$ from the upper side. $G_1$ is located at the uppermost portion, and $G_N$ is located at the lowermost portion. The number N of shallow grooves G is, for example, 30 (inclusive) to 90 (inclusive). The number of shallow grooves G shown in each drawing is only for the descriptive convenience.

There exist n pitches P between the shallow grooves G. Note that n=N−1. To discriminate the pitches P, they are sequentially numbered as $P_1$, $P_2$, $P_3$, $P_4$, . . . , $P_n$ from the upper side. $P_1$ is the pitch between the shallow groove $G_1$ and the shallow groove $G_2$. $P_2$ is the pitch between the shallow groove $G_2$ and the shallow groove $G_3$. $P_n$ is the pitch between the shallow groove $G_{N-1}$ and the shallow groove $G_N$.

The pitches P hold a relationship given by $$P_1 \geq P_2 \geq \ldots \geq P_n, \text{ and}$$

$$P_1 > P_n.$$

This expression means that the number of shallow grooves G is relatively small on the upper side of the face portion 11 and relatively large on the lower side. That is, the surface roughness of the surface of the face portion 11 is relatively low on the upper side of the face portion 11 and relatively high on the lower side.

As already described above, in a wood type golf club head, the back spin amount tends to be low when the position of the impact point is high, on the face portion, and tends to be high when the position of the impact point is low. In addition, in a golf club head having a relatively small loft angle (for example, 20° or less), in some cases, the higher the surface roughness is, the lower the back spin amount is.

The golf club head 10 according to this embodiment is a wood type golf club head. The surface roughness is relatively low on the upper side of the face portion 11. This can suppress the decrease in the back spin amount when the position of the impact point is high. The surface roughness is relatively high on the lower side of the face portion 11. This can suppress the increase in the back spin amount when the position of the impact point is low. It is therefore possible to reduce the difference in the back spin amount generated by the vertical variation in the impact point position.

The surface roughness of the face portion 11 preferably changes in the vertical direction as continuously as possible. Hence, for example, $$P_1 > P_k > P_n \ (1<k<n)$$

may hold. $P_k$ may be a pitch at the center of the face portion 11.

For example, $$P_1 > P_j > P_k > P_n \ (1<j<k<n)$$

may hold. $P_j$ may be a pitch on the upper side of the center of the face portion 11, and $P_k$ may be a pitch on the lower side of the center of the face portion 11.

For example, $$P_1 = P_2 > P_3 = P_4 > P_5 = P_6 > \ldots > P_{n-1} = P_n$$

may hold. The number of identical pitches is 2 in this example, but may be 3 or 4. The number of identical pitches may change, for example, 2→3→2 . . . .

For example, $$P_1 > P_2 > \ldots > P_n$$

is preferable. When all pitches P are different, the surface roughness of the face portion 11 can be changed continuously in the vertical direction.

Note that the maximum pitch $P_1$ can be, for example, 1 mm (inclusive) to 5 mm (inclusive). The minimum pitch $P_n$ can be, for example, 100 μm (inclusive) to 200 μm (inclusive).

The surface roughness of the face portion 11 is represented by the average value of arithmetic mean roughnesses Ra. For example, lower area: 2 μm or more central area: 1 μm (inclusive) to 2 μm (exclusive)

upper area: less than 1 μm

In this case, the average value of the arithmetic mean roughnesses Ra in the lower area may be 4.5 μm or less, and the average value of the arithmetic mean roughnesses Ra in the upper area may be 0.3 μm or more. A structure having no shallow grooves G in the upper area can also be employed.

Figure 3A:
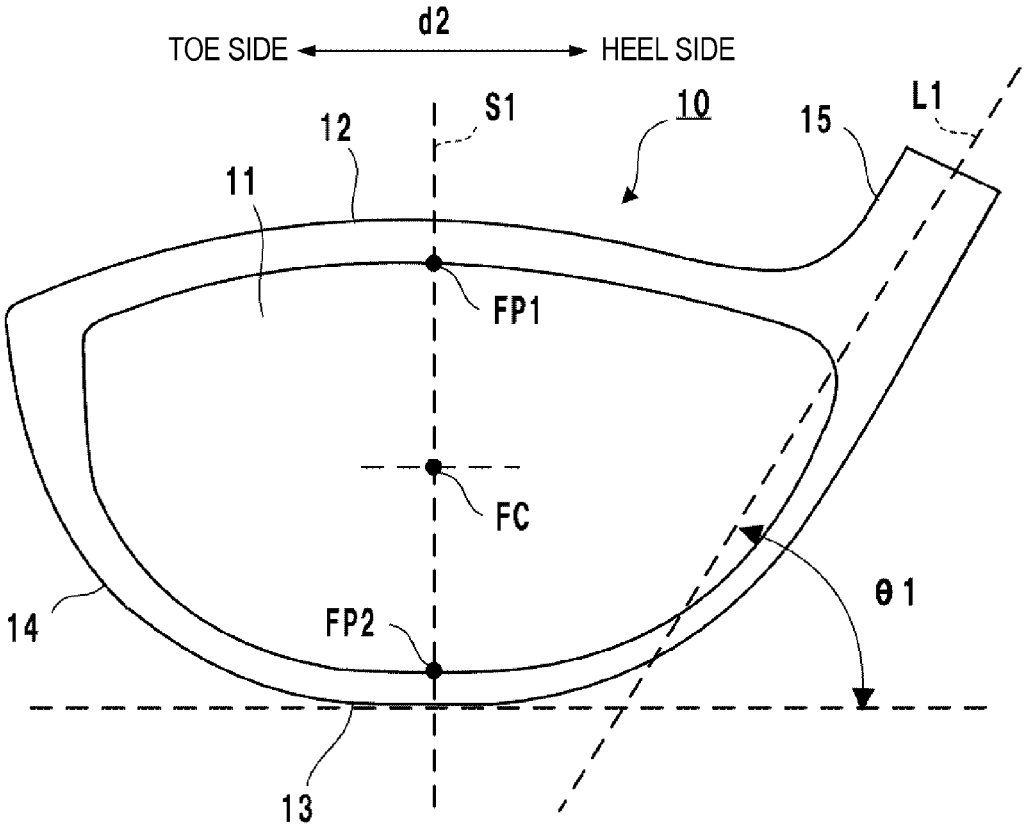
FIGS. 3A and 3B are explanatory views of a face center and the maximum height of a face portion.
Figure 3B:
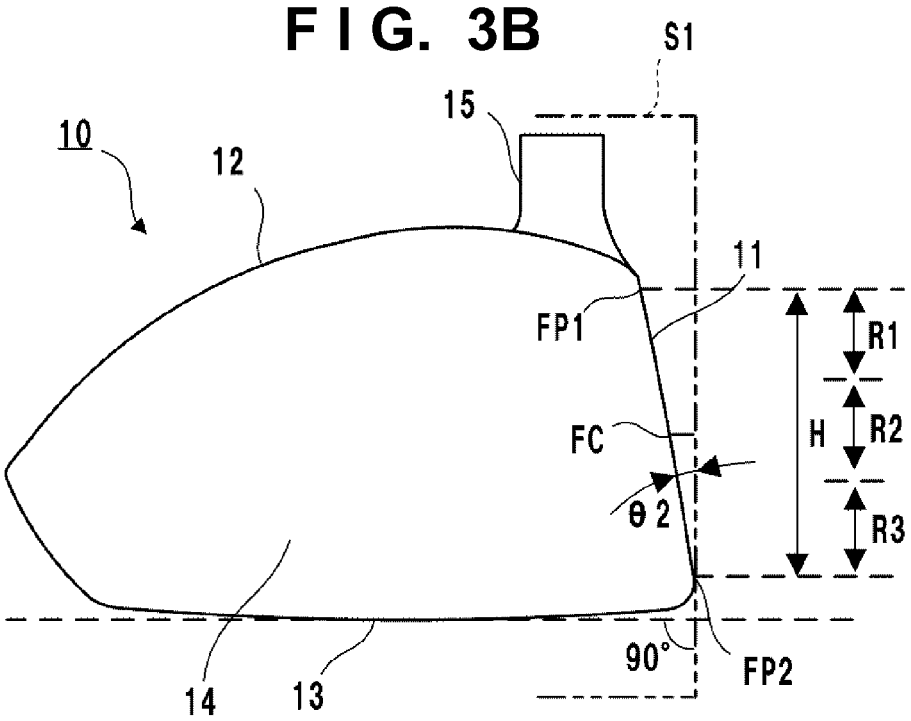

The lower area, the central area, and the upper area may be divided based on, for example, the maximum height of the face portion 11 in the vertical direction. FIGS. 3A and 3B are explanatory views.

Referring to FIG. 3A, a plane S1 is a virtual vertical plane that passes through a geometric center Fc of the face portion 11 and is perpendicular to the ground surface and the toe-heel direction when the golf club head 10 is grounded at the predetermined lie angle θ1 and a predetermined loft angle θ2. Let FP1 and FP2 be the upper and lower ends of the surface of the face portion 11 crossing the plane S1, respectively. A height difference H between the positions FP1 and FP2 is defined as the height of the face portion 11.

A lower area R3 is, for example, an area of H×0.3 from the lower end of the face portion 11. A central area R2 is, for example, an area of H×0.7 from the upper end of the lower area R3. An upper area R1 is, for example, an area from the upper end of the central area R2 to the upper end of the face portion 11. They are expressed by numerical values as lower area R3≤H×0.3, H×0.3<central area R2≤H×0.7, and upper area R1>H×0.7.

Figure 4A:
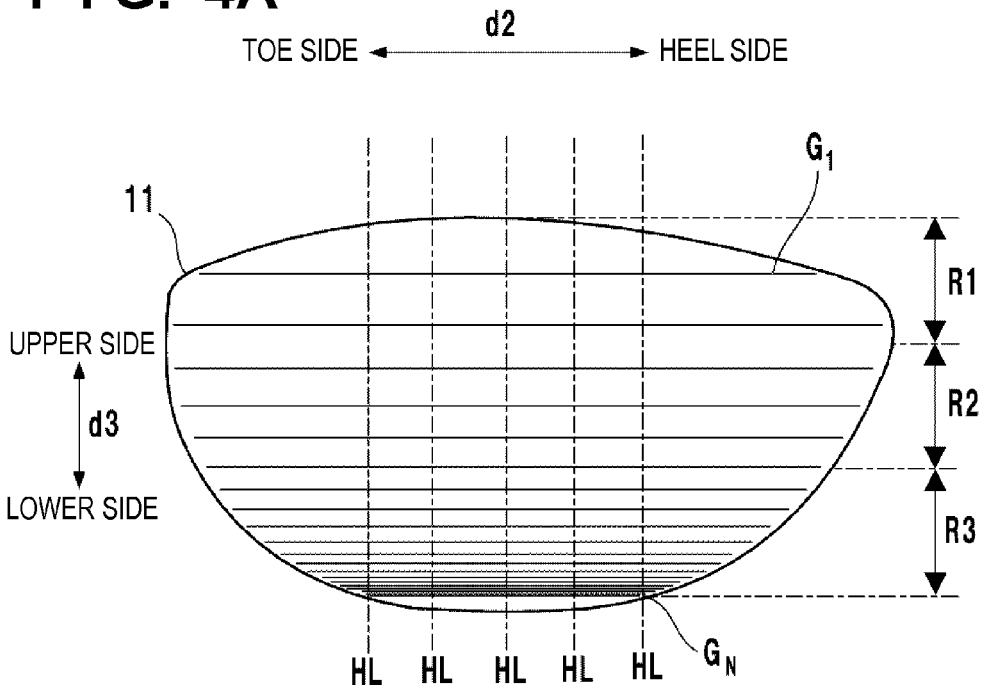
FIG. 4A is an explanatory view of an example of surface roughness measurement.

When measuring the arithmetic mean roughness Ra, average lines can be set as shown in FIG. 4A. Referring to FIG. 4A, average lines HL are set in the vertical direction of the face portion 11. A plurality of average lines HL are set in the toe-heel direction. The arithmetic mean roughness Ra of each area is measured along each average line HL, and the average value of the arithmetic mean roughnesses Ra can be obtained.

As the forming method of the shallow grooves G, machining, laser machining, chemical milling, etching, and press working are usable. Laser machining is preferable. As a procedure of processing, for example, a golf club head formed as a hollow member is fixed in a numerically controlled processing apparatus, thereby forming the shallow grooves G in the face portion 11.

As another procedure of processing, when assembling the golf club head 10 by joining a plurality of parts, a flat face member is fixed in a numerically controlled processing apparatus, and the shallow grooves G are formed. When formation of the shallow grooves G is completed, the face member is bent to form a bulge and a roll. After that, the face member is joined to the opening of the main body member. In this procedure, since the face member is flat in the step of forming the shallow grooves G, the shallow grooves G can be formed more accurately.

In this embodiment, the pitch P between the shallow grooves G is changed, thereby locally controlling the surface roughness of the face portion 11. As a method of adjusting the surface roughness of the face portion, a process such as sand blast or shot peening is known. However, it is not necessarily easy to locally control the surface roughness. In this embodiment, since the pitch P between the shallow grooves G is only changed, it is relatively easy to locally control the surface roughness. In addition, since the shallow grooves G are not score lines under the rules (R & A rules), no restrictions concerning score lines are imposed. It is therefore possible to obtain the above advantages while conforming to the rules.

Second Embodiment

Figure 4B:
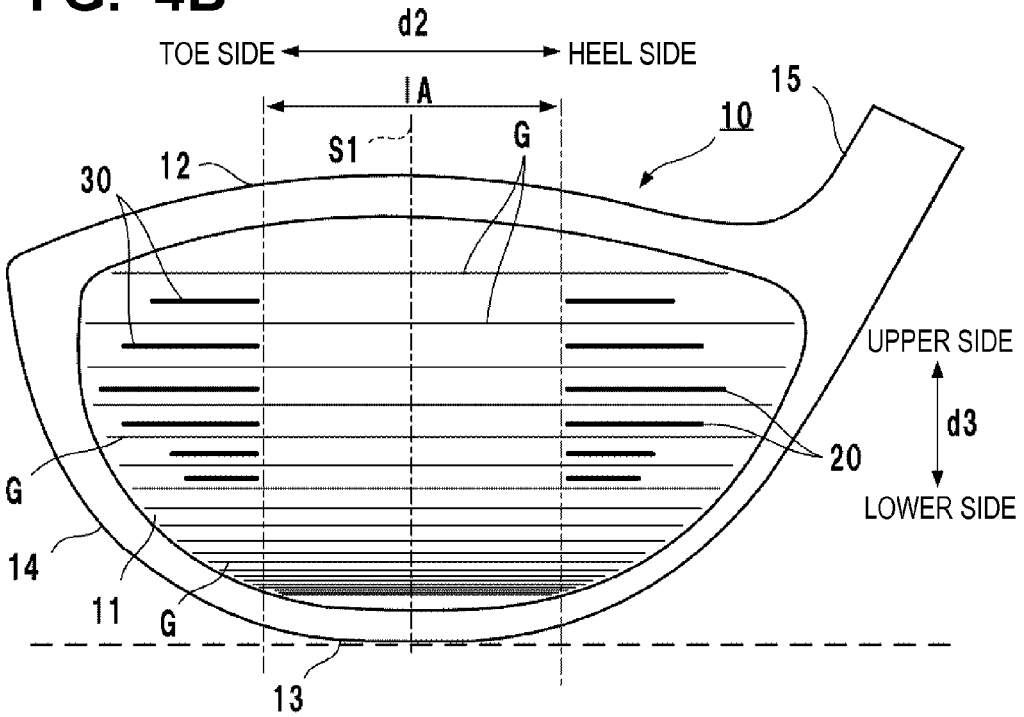
FIG. 4B is an explanatory view of another example.

In addition to shallow grooves G, score lines may be formed in a face portion 11. FIG. 4B shows an example. In the example of FIG. 4B, score lines 20 are formed in areas except an impact area IA. The score lines 20 are straight grooves extending in the toe-heel direction and are formed in parallel to each other.

In a driving club or a fairway wood, the impact area IA is a band-shaped portion passing through the center of the club face and having a width of 1.68 inches (42.67 mm) under the rules (R & A rules).

The score lines 20 can be formed even in the impact area IA. However, when the score lines 20 are formed in areas except the impact area IA, the surface roughness can easily be controlled by the shallow grooves G in the impact area IA without being affected by the score lines 20.

Third Embodiment

In the first and second embodiments, the shallow grooves G are formed all over the face portion 11. However, the shallow grooves G may partially be formed. When partially forming the shallow grooves G, they can be formed in, for example, an impact area IA or an area including the impact area IA.

Fourth Embodiment

Figure 5A:
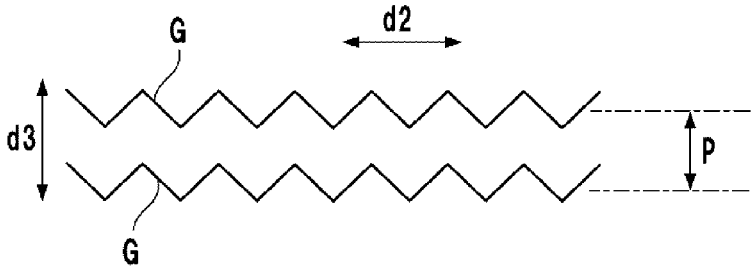
FIGS. 5A to 5E are explanatory views of other examples of shallow grooves.
Figure 5B:
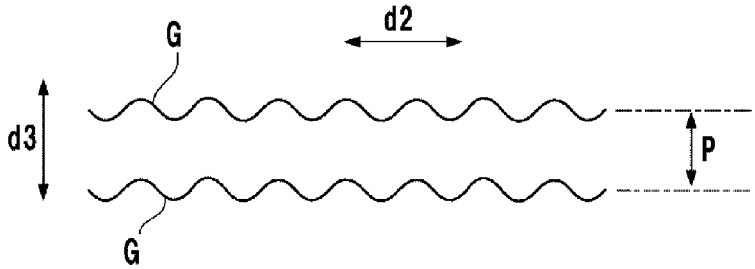

In the first embodiment, the shallow grooves G have been explained as straight grooves. However, shallow grooves G may be grooves having another shape. FIGS. 5A to 5D show examples. FIGS. 5A and 5B show examples of the shallow grooves G having wavy shapes. FIG. 5A shows a case where the shallow grooves G are formed into a triangular wave shape, and FIG. 5B shows a case where the shallow grooves G are formed into a sine wave shape. A pitch P uses, as a reference, the center between the upper and low ends of each shallow groove G. The pitch P can use any reference as long as it is consistently determined.

Figure 5C:
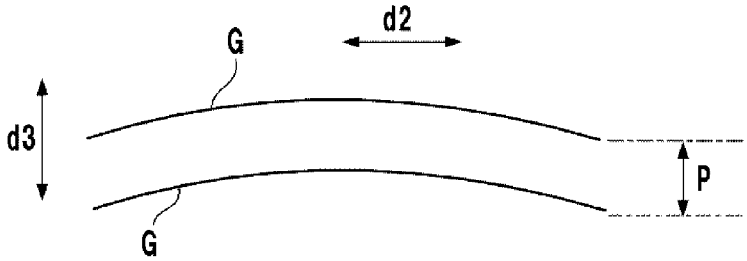

FIG. 5C shows an example in which the shallow grooves G are grooves having an arc shape. In this example, the pitch P uses an end of each shallow groove G as a reference.

Figure 5D:
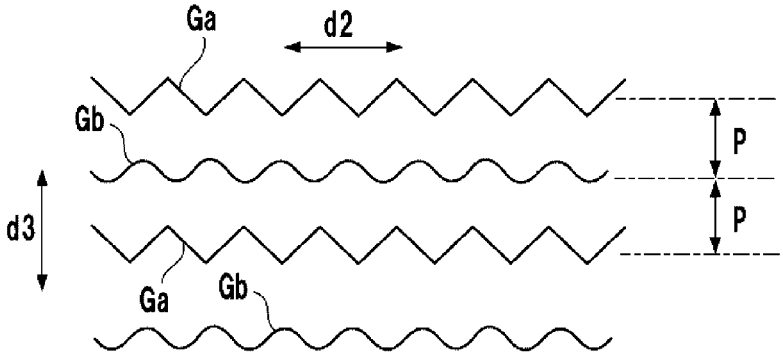

FIG. 5D shows an example in which shallow grooves Ga having a triangular wave shape and shallow grooves Gb having a sine wave shape are repetitively formed. As in this example, the shallow grooves G may be formed by periodically forming grooves having different shapes.

Figure 5E:
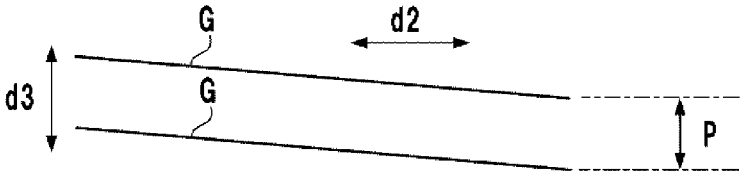

In the first embodiment, the shallow grooves G are formed so as to be level when the golf club head 10 is grounded toward the target direction. However, the shallow grooves G need not be level. FIG. 5E shows an example. FIG. 5E shows the shape of each shallow groove G when the golf club head 10 is grounded toward the target direction. The shallow grooves G tilt from a level state.

Examples

Figures 6A, 6B:
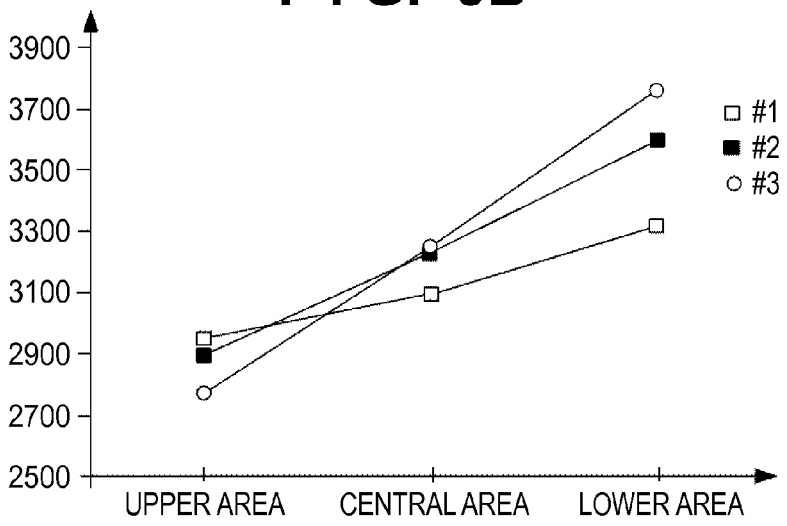
FIGS. 6A and 6B are views showing details of experiments.

Prototypes of golf club heads were made, and back spin amount evaluation tests were conducted. FIG. 6A shows the specifications and test results of the prototypes. FIG. 6B is a graph showing the test results.

Golf club heads #1 to #3 are heads for a driver having a loft angle of 11° and have the same specifications except the conditions of the shallow grooves or score lines of the face portion.

Golf club head #1 is a head having shallow grooves but no score lines in the face portion. The structure of the shallow grooves is the same as in the first embodiment (straight grooves extending in the toe-heel direction). The pitch field shows the pitches between the shallow grooves. The pitch changes between the upper area, the central area, and the lower area, and is 3.0 mm in the upper area, 1.2 mm in the central area, and 0.6 mm in the lower area. These areas comply with the division of the areas R1 to R3 described with reference to FIGS. 3A and 3B. The same applies to the upper area, the central area, and the lower area below.

Golf club heads #2 and #3 are heads having no shallow grooves but score lines in the face portion. The score lines are straight grooves extending in the toe-heel direction and are formed all over the face portion. The pitch field shows the pitches between the score lines. In golf club head #2, the pitch changes between the upper area, the central area, and the lower area. The pitch is 6.0 mm in the upper area, 4.0 mm in the central area, and 2.0 mm in the lower area. Golf club head #2 does not confirm to the rules (R & A rules). Golf club head #3 has an equal pitch (4 mm) and specifications close to those of a commercially available golf club head.

In the back spin amount evaluation tests, a swing robot available from Miyamae hit golf balls under the same conditions, and the back spin amounts were measured. The impact point was set in each of the upper area, central area, and lower area of the face portion. Numerical values shown in the spin amount field of FIG. 6A are the average values of back spin amounts in a plurality of times of launch monitor. FIG. 6B is a graph of the results shown in the spin amount field of FIG. 6A.

As is apparent from comparison of golf club heads #1 and #3, the difference in the back spin amount caused by the variation in the impact point is small in golf club head #1. This is probably caused by the change in the surface roughness of the face portion by the shallow grooves.

In golf club head #2 as well, the difference in the back spin amount caused by the variation in the impact point is smaller than in golf club head #3 but falls short of the level of golf club head #1. It is estimated that the shallow grooves more precisely locally control the surface roughness of the face portion. In addition, golf club head #2 does not conform to the rules (R & A rules), but golf club head #1 does.

Note that there was not much difference of flaws on balls after hit between the golf club heads.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-121827, filed Jun. 12, 2014, which is hereby incorporated by reference herein in its entirety.

What is claimed is:

1. A wood type golf club head including, a crown portion on an upper side of the head, a sole portion on the lower side of the head and a face portion between the crown portion and the sole portion, wherein a plurality of grooves arrayed in a vertical direction of the face portion are formed in the face portion, a depth of the plurality of grooves is less than 0.025 mm, and when pitches between grooves, among the plurality of grooves, that are adjacent in the vertical direction of the face portion are represented by $P_1$, $P_2$, . . . , $P_n$ sequentially from an upper side to a lower side of the face portion $$P_1 \geq P_2 \geq \ldots \geq P_n, \text{ and}$$

$$P_1 > P_n,$$

the face portion includes a lower area, a central area, and an upper area, letting H be a height of the face portion in the vertical direction, the lower area is an area of H×0.3 from a lower end of the face portion, the central area is an area of H×0.7 from an upper end of the lower area, and the upper area is an area from the upper end of the central area to the upper end of the face portion, and when a surface roughness of the face portion is measured as an arithmetic mean roughness Ra using an average line in the vertical direction, an average value of the arithmetic mean roughness Ra of the lower area is 2 μm or more, the average value of the arithmetic mean roughness Ra of the central area is not less than 1 μm and less than 2 μm, and the average value of the arithmetic mean roughness Ra of the upper area is less than 1 μm.

2. The golf club head according to claim 1, wherein $$1 \text{ mm} \leq P_1 \leq 5 \text{ mm, and}$$

$$100 \ \mu\text{m} \leq P_n \leq 200 \ \mu\text{m}.$$

3. The golf club head according to claim 1, wherein the plurality of grooves are formed by laser machining.

4. The golf club head according to claim 1, wherein the face portion includes an impact area, and there are no scorelines in the impact area.

5. The golf club head according to claim 1, wherein each of the plurality of grooves comprises a straight groove extending in a direction perpendicular to the vertical direction.

6. The golf club head according to claim 1, wherein the grooves are not formed in the upper area.

7. The golf club head according to claim 1, wherein $P_1 > P_k > P_n$ $(1<k<n)$.

8. The golf club head according to claim 1, wherein $P_1 > P_j > P_k > P_n$ $(1<j<k<n)$.

9. The golf club head according to claim 1, wherein $P_1 > P_2 > \ldots > P_n$.

10. A wood type golf club head including, a crown portion on an upper side of the head, a sole portion on a lower side of the head and face portion between the crown portion and the sole portion, wherein a plurality of grooves arrayed in a vertical direction of the face portion are formed in the face portion, a depth of the plurality of grooves is less than 0.025 mm, pitches between grooves, among the plurality of grooves, that are adjacent in the vertical direction of the face portion change such that a surface roughness of the face portion rises from an upper side to a lower side, the face portion includes a lower area, a central area, and an upper area, letting H be a height of the face portion in the vertical direction, the lower area is an area of H×0.3 from a lower end of the face portion, the central area is an area of H×0.7 from an upper end of the lower area, and the upper area is an area from the upper end of the central area to the upper end of the face portion, and when a surface roughness of the face portion is measured as an arithmetic mean roughness Ra using an average line in the vertical direction, an average value of the arithmetic mean roughness Ra of the lower area is 2 μm or more, the average value of the arithmetic mean roughness Ra of the central area is not less than 1 μm and less than 2 μm, and the average value of the arithmetic mean roughness Ra of the upper area is less than 1 μm.

* * * * *